US007559633B2

(12) United States Patent
Sugahara

(10) Patent No.: US 7,559,633 B2
(45) Date of Patent: Jul. 14, 2009

(54) LIQUID-DROPLET JETTING APPARATUS AND LIQUID TRANSPORTING APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 496 days.

(21) Appl. No.: 11/513,404

(22) Filed: Aug. 31, 2006

(65) Prior Publication Data

US 2007/0046737 A1 Mar. 1, 2007

(30) Foreign Application Priority Data

Aug. 31, 2005 (JP) ..... 2005-252107

(51) Int. Cl.
*B41J 2/045* (2006.01)

(52) U.S. Cl. ..... 347/71

(58) Field of Classification Search ..... 347/71–72, 347/68–70; 400/124.16
See application file for complete search history.

(56) References Cited

U.S. PATENT DOCUMENTS

| | | | |
|---|---|---|---|
| 6,969,158 | B2 | 11/2005 | Taira |
| 2003/0025769 | A1 | 2/2003 | Shingai et al. |
| 2003/0085961 | A1 | 5/2003 | Furuhata |
| 2003/0112298 | A1 | 6/2003 | Sato et al. |
| 2005/0036011 | A1 | 2/2005 | Watanabe |
| 2006/0152556 | A1 * | 7/2006 | Sugahara ..... 347/71 |

FOREIGN PATENT DOCUMENTS

| | | |
|---|---|---|
| EP | 1657059 A2 | 5/2006 |
| JP | 2004136668 | 5/2004 |
| JP | 200559328 | 3/2005 |

OTHER PUBLICATIONS

Communication (including European Search Report for European Patent Appl'n No. EP 06018122 (counterpart to U.S. Appl. No. 11/513,404)), 4 pages, dated Feb. 21, 2008.

* cited by examiner

*Primary Examiner*—K. Feggins
(74) *Attorney, Agent, or Firm*—Baker Botts L.L.P.

(57) ABSTRACT

A piezoelectric actuator includes a channel unit having a manifold and pressure chambers; a vibration plate covering the pressure chambers and the manifold; a piezoelectric layer formed on an upper surface of the vibration plate; individual electrodes formed on an upper surface of the piezoelectric layer; and contact points each drawn on the upper surface of the piezoelectric layer from one of the individual electrodes up to an area facing the manifold. Supporting sections, contacting with a surface of the vibration plate and extended from the inner surface of the manifold, is formed at areas of the channel unit each overlapping with a tip of one of the contact points. Accordingly, sufficient pressure to the contact points can be exerted upon connecting the piezoelectric actuator and a wiring member. A liquid transporting apparatus having a high reliability of electrical connections can be provided.

15 Claims, 12 Drawing Sheets

LIQUID-DROPLET JETTING APPARATUS AND LIQUID TRANSPORTING APPARATUS

CROSS REFERENCE TO RELATED APPLICATION

The present application claims priority from Japanese Patent Application No. 2005-252107, filed on Aug. 31, 2005, the disclosure of which is incorporated herein by reference in its entirety.

BACKGROUND OF THE INVENTION

1. Field of the Invention

The present invention relates to a liquid-droplet jetting apparatus which jets liquid droplets, and a liquid transporting apparatus which transports a liquid.

2. Description of the Related Art

As an ink-jet head which jets liquid droplets from a nozzle, ink-jet heads having various structures have been hitherto known. For example, U.S. Pat. No. 6,969,158 discloses an ink-jet head which includes a channel unit provided with a plurality of pressure chambers which are arranged along a plane and which communicate with a plurality of nozzles, respectively; and a piezoelectric actuator which selectively applies a pressure to an ink in the pressure chambers.

The channel unit has a structure in which a plurality of plates including a cavity plate in which the pressure chambers are formed, and a manifold plate in which a manifold communicating commonly with the pressure chambers are stacked; and in which the pressure chambers are arranged to be disposed above the manifold and to overlap partially with the manifold in a plan view.

The piezoelectric actuator includes a plurality of piezoelectric layers (piezoelectric sheets) arranged continuously on an upper surface of the cavity plate so as to cover the pressure chambers; a plurality of individual electrodes arranged on an upper surface of a piezoelectric layer disposed uppermost in the piezoelectric layers, so as to face the pressure chambers respectively; and a common electrode which faces the individual electrodes, respectively, sandwiching the uppermost piezoelectric layer between the common electrode and the individual electrodes. Further, a plurality of contact points (land portions) are drawn from the individual electrodes respectively, and contact points of a flexible printed circuit (FPC) are electrically connected to the contact points of the individual electrodes respectively. Furthermore, when a drive voltage is applied via the FPC, to a certain individual electrode of the individual electrodes, from a driver IC which is a driving circuit, an electric field is generated in a portion of the piezoelectric layer between this individual electrode and the common electrode, thereby deforming the piezoelectric layer. With the deformation of the piezoelectric layer, a volume of a pressure chamber, included in the pressure chambers and facing the individual electrode to which the drive voltage was supplied, is changed, thereby applying a pressure to the ink in the pressure chamber.

Upon connecting the FPC to the piezoelectric actuator, the piezoelectric actuator and the FPC are joined by a solder or the like, while pressing the FPC against the contact point of the piezoelectric actuator. At this time, when rigidity (stiffness) of an area of the piezoelectric actuator at which the contact points are arranged is low, the FPC cannot be pressed sufficiently against the contact points, thereby lowering a reliability of electrical connection between the piezoelectric actuator and the FPC. In view of this, in the ink-jet head described in U.S. Pat. No. 6,969,158, each of the contact points on the upper surface of the piezoelectric layer is drawn from one of the individual electrodes, formed on the upper surface of the piezoelectric layer at an area facing one of the pressure chambers which is a cavity, up to another area having high rigidity (area facing one of partition walls separating the pressure chambers) and not facing the pressure chamber.

In the above-mentioned ink-jet head described in the U.S. Pat. No. 6,969,158, positions of the pressure chambers and the manifold are different in view of the vertical positional relationship. Therefore, a communicating channel communicating each of the pressure chambers and the manifold is required to be formed such that the communicating channel is extended in a direction of thickness of the channel unit, and thus a shape of the ink channel becomes complicated. Further, since it is necessary to stack a plate additionally for forming the communicating channel extended in the direction of thickness, thus increasing the number of plates.

SUMMARY OF THE INVENTION

An object of the present invention is to provide a liquid droplet jetting apparatus and a liquid transporting apparatus in which it is possible to simplify a shape of a liquid channel, and to secure a high reliability of the electric connections between the actuator and a wiring member such as the FPC without increasing the overall size of the apparatus.

According to a first aspect of the present invention, there is provided a liquid-droplet jetting apparatus which jets a liquid droplet, including:

a channel unit which includes a plurality of nozzles; a plurality of pressure chambers arranged along a plane and communicating with the nozzles respectively; and a common liquid chamber arranged along the plane and adjacent to the pressure chambers; and a piezoelectric actuator which is arranged on one surface of the channel unit so as to cover the pressure chambers, and extended from an area above the channel unit and facing the pressure chambers up to another area above the channel unit and facing the common liquid chamber; which applies a pressure to a liquid in the pressure chambers by selectively changing volumes of the pressure chambers; and which includes: a piezoelectric layer arranged at the area facing the pressure chambers; a plurality of individual electrodes which are arranged on one surface of the piezoelectric layer, at the area facing the pressure chambers so as to correspond to the pressure chambers respectively; a common electrode arranged on the other surface of the piezoelectric layer; and a plurality of contact points which are connected to the individual electrodes respectively, and are exposed on the one surface of the piezoelectric layer, on a side opposite to the pressure chambers and the common liquid chamber;

wherein each of the contact points is drawn, on the one surface of the piezoelectric layer on the side opposite to the pressure chambers and the common liquid chamber, from one of the individual electrodes up to the another area facing the common liquid chamber; and the channel unit is provided with a plurality of supporting sections which are formed in the channel unit, which are in contact with a surface of the piezoelectric actuator on a side of the common liquid chamber, and which are extended from an inner surface of the common liquid chamber up to positions each facing one of the contact points.

According to the first aspect of the present invention, in this liquid-droplet jetting apparatus, when a drive voltage is applied to a certain individual electrode of the individual electrodes, an electric field is generated in the piezoelectric layer between this individual electrode and the common electrode, and thus the piezoelectric layer is deformed. With the deformation of the piezoelectric layer, since a volume of a pressure chamber included in the pressure chambers and corresponding to the certain individual electrode to which the drive voltage is applied is changed so as to apply a pressure to the liquid in the pressure chamber, thereby jetting a liquid droplet from a nozzle corresponding to the pressure chamber.

In the present invention, the pressure chambers and at least a part of the common liquid chamber are arranged adjacently along the plane, and a vertical position of the pressure chambers and a manifold (common liquid chamber) is substantially same. Therefore, when the pressure chambers and the common liquid chamber are communicated, a communicating channel may be formed along the plane, simplifying a shape of a liquid channel. Accordingly, it is possible to reduce the manufacturing cost. In particular, when the channel unit is made of a plurality of plates stacked in a laminated form, it is possible to reduce the number of plates to be stacked. However, with only this construction, the pressure chambers which are a cavity and the manifold are almost on the same plane, and accordingly, on an upper surface of the piezoelectric layer, an area having a low rigidity becomes wide because the area is facing one of the pressure chamber and the manifold, while another area having a high rigidity which is necessary for arranging each of the contact points becomes narrow. Therefore, it is difficult to densely arrange a large number of the contact points, which in turn causes to hinder the reduction of size of the ink-jet head.

In view of the above problem, in the present invention, each of the contact points connected to the individual electrodes respectively is drawn up to an area, on the surface of the piezoelectric layer, facing the common liquid chamber; and further, the plurality of supporting sections are provided, in contact with the piezoelectric actuator, in the channel unit at positions each facing one of the contact points. Therefore, the rigidity of the areas of the piezoelectric actuator in which the contact points are respectively arranged becomes high despite of facing the common liquid chamber which is a cavity, and it is possible to connect a wiring member such as an FPC to the contact points by pressing the FPC or the like against the contact points sufficiently. Therefore, a reliability of electric connections between the contact points and the wiring member is improved. Further, as compared to a case in which the contact points are arranged only at areas each of which not faces the cavity of one of the pressure chambers and of the common liquid chamber, areas in which the contact points can be arranged becomes wider, and it possible to arrange a large number of contact points densely without increasing the size of the overall apparatus.

In the liquid-droplet jetting apparatus of the present invention, the supporting sections may be projected, toward an inner side of the common liquid chamber, from partition walls, respectively, which separate the pressure chambers and the common liquid chamber; and communicating channels may be formed, each between a supporting section, which is included in the supporting sections and which corresponds to a pressure chamber included in the pressure chambers, and another supporting section corresponding to another pressure chamber adjacent to the pressure chamber, so as to communicate the pressure chamber and the common liquid chamber. In this case, since a communicating channel which communicates a certain pressure chamber and the common liquid chamber communicate is sandwiched between a supporting section corresponding to this pressure chamber and another supporting section corresponding to another pressure chamber adjacent the certain pressure chamber. Accordingly, between the certain pressure chamber and the adjacent pressure chamber, a pressure wave which generated in the certain pressure chamber is suppressed to propagate to another pressure chamber via the common pressure chamber (fluid cross-talk is suppressed).

In the liquid-droplet jetting apparatus of the present invention, the supporting sections may be projected, toward an inner side of the common liquid chamber, from partition walls, respectively, which separate the pressure chambers and the common liquid chamber; and two communicating channels may be formed on both sides, respectively, of a supporting section included in the supporting sections and corresponding to a pressure chamber included in the pressure chambers so as to communicate the pressure chamber and the common liquid chamber. In this case, for a pressure chamber, the liquid flows from the common liquid chamber into the pressure chamber through two communicating channels. Accordingly, the liquid is hardly stagnated in the pressure chamber and an air bubble hardly stays inside the pressure chamber.

In the liquid-droplet jetting apparatus of the present invention, a channel area of each of the communicating channels may be narrowed progressively from the common liquid chamber toward one of the pressure chambers. In this case, the liquid is hardly stagnated in each of the pressure chambers, and thus the air bubble hardly stays inside the pressure chamber.

In the liquid-droplet jetting apparatus of the present invention, the channel unit may have a plurality of stacked plates including a pressure chamber plate in which the pressure chambers are formed; and the supporting sections and the communicating channels may be formed in the pressure chamber plate. In this case, it is possible to form the supporting sections and the communicating channels at a time by a method such as an etching. Furthermore, it is also possible to form the supporting sections and the communicating channels simultaneously with the pressure chambers.

In the liquid-droplet jetting apparatus of the present invention, the communicating channels may be formed by a half etching on a surface of the pressure chamber plate on which the piezoelectric actuator is arranged. When each of the communicating channels is formed as a groove by the half etching, the rigidity of the pressure chamber plate becomes higher as compared to that in a case in which each of the communicating channels is formed as a through hole by a full etching. Accordingly, the handling of the pressure chamber plate during the manufacturing becomes easier. Further, compared with a case in which the communicating channels are formed by the half etching on a surface of the pressure chamber plate opposite to the piezoelectric actuator, the air bubble hardly stays inside the communicating channels.

In the liquid-droplet jetting apparatus of the present invention, the channel unit may have a plurality of stacked plates including a pressure chamber plate in which the pressure chambers are formed; the supporting sections may be projected, in the pressure chamber plate, toward an inner side of the common liquid chamber from partition walls, respectively, which separate the pressure chambers and the common liquid chamber; and communicating channels each of which communicates one of the pressure chambers and the common liquid chamber may be formed in a plate which is included in the plates and which is in contact with a surface of the pressure chamber plate on a side opposite to the piezoelectric actuator. In this case, since the communicating channels are formed on a different (separate) plate which is in contact with the pressure chamber plate having the supporting sections formed therein, positions of the communicating channel are not constrained by the supporting sections, thereby increasing a degree of freedom of designing.

In the liquid-droplet jetting apparatus of the present invention, a shape of tips of the supporting sections may be substantially same as a shape of the contact points to which the supporting sections face respectively; and a size of the tips of the supporting sections may be greater than a size of the contact points to which the supporting sections face respectively, and of each of the contact points may overlap entirely with one of the supporting sections as viewed from a direction orthogonal to the plane. In this case, it is possible to secure reliability at the time of connecting the contact points and a wiring member such as FPC by pressing the wiring member against the contact point, without unnecessarily increasing the size of the tips of the supporting sections.

In the liquid-droplet jetting apparatus, the shape of the tips of the supporting sections may be a circular arc. In this case, it is possible to reduce a concentration of stress generated in the supporting sections when the wiring member such as an FPC is pressed against the contact points.

In the liquid-droplet jetting apparatus of the present invention, the piezoelectric actuator may include a vibration plate which is arranged on the one surface of the channel unit so as to cover the pressure chambers, and may be extended from the area facing the pressure chambers up to the another area facing the common liquid chamber; the piezoelectric layer may be arranged on a surface of the vibration plate on a side opposite to the pressure chambers; and the supporting sections may be in contact with a surface of the vibration plate on a side of the pressure chambers, and may be extended, from an inner surface defining the common liquid chamber, up to positions each facing one of the contact points. Thus, a same effect as in the invention described above can be achieved also in a case of a so-called unimorph actuator in which the piezoelectric actuator includes the vibration plate covering the pressure chambers and the piezoelectric layer arranged on this vibration plate.

In the liquid-droplet jetting apparatus of the present invention, the pressure chambers may have an elongated shape; and each of the contact points may be arranged to be shifted from a center of one of the pressure chambers in a direction of width of one of the pressure chambers. In this case, since each of the contact points is shifted from a center of the pressure chamber toward on one side in the direction of width of one of the pressure chambers, it is possible to form, for example, a communicating channel which communicates the common liquid chamber and one of the pressure chambers, on the other side in the direction of width of one of the pressure chambers.

In the liquid-droplet jetting apparatus of the present invention, the common liquid chamber may includes a plurality of liquid chambers; a pressure chamber, included in the pressure chambers, may be communicated with a liquid chamber which is included in the liquid chambers and which overlaps with a contact point included in the contact points and connected to an individual electrode included in the individual electrodes and corresponding to the pressure chamber. Alternatively, the common liquid chamber may include a plurality of liquid chambers; and a pressure chamber, included in the pressure chambers, may be communicated with a liquid chamber included in the liquid chambers and different form another liquid chamber which overlaps with a contact point included in the contact points and connected to an individual electrode included in the individual electrodes and corresponding to the pressure chamber. Thus, it is possible to arrange each of the contact points, on the surface of the piezoelectric layer, at a position overlapping with one of the liquid chambers of the common liquid chamber which communicates with a pressure chamber corresponding to an individual electrode connected to each of the contact points; or to arrange at a position overlapping with one of the liquid chambers of the common liquid chamber which does not communicate with a pressure chamber corresponding to an individual electrode connected to each of the contact points. Accordingly, a degree of freedom of arranging the contact points becomes higher.

In the liquid-droplet jetting apparatus of the present invention, each of the contact points, corresponding to one of the pressure chambers, and communicating channels, communicating one of the pressure chambers and the common liquid chamber, may be formed on mutually opposite sides, respectively, of one of the pressure chambers, sandwiching one of the pressure chambers therebetween. In this case, since the communicating channels and the supporting section are formed on the mutually opposite sides sandwiching the pressure chamber therebetween, the degree of freedom of arranging the contact points and the communicating channels becomes higher.

According to a second aspect of the present invention, there is provided a liquid transporting apparatus which transports a liquid, including:

a channel unit which includes a plurality of pressure chambers arranged along a plane, and a common liquid chamber arranged along the plane and adjacent to the pressure chambers; and a piezoelectric actuator which applies a pressure to a liquid in the pressure chambers by selectively changing volumes of the pressure chambers, and which includes: a vibration plate which is arranged on one surface of the channel unit so as to cover the pressure chambers, and is extended from an area facing the pressure chambers up to another area facing the common liquid chamber; a piezoelectric layer arranged on a surface of the vibration plate, on a side opposite to the pressure chambers, at the area facing the pressure chambers; a plurality of individual electrodes arranged, on a surface of the piezoelectric layer on a side opposite to the pressure chambers, at the area facing the pressure chambers; a plurality of contact points which are connected to the individual electrodes respectively; and a common electrode which is arranged on a surface of the piezoelectric layer on a side of the pressure chambers;

wherein each of the contact points is drawn, on the surface of the vibration plate on the side opposite to the pressure chambers, from one of the individual electrodes up to the another area facing the common liquid chamber; and the channel unit is provided with a plurality of supporting sections which are formed in the channel unit, which are in contact with a surface of the vibration plate on a side of the common liquid chamber, and which are extended from an inner surface of the common liquid chamber up to positions each facing one of the contact points.

In this liquid transporting apparatus also, the pressure chambers and at least a part of the common liquid chamber are adjacent along the plane. Accordingly, it is possible to simplify the shape of the liquid channel, and to reduce the manufacturing cost. Further, the contact points connected to the individual electrodes respectively, are drawn, on the surface of the piezoelectric layer, up to the area facing the common liquid chamber, and the supporting sections are provided in the channel unit at positions each facing one of the contact points. Therefore, the rigidity of the area of the piezoelectric actuator in which the contact points are provided becomes higher in spite of facing the common liquid chamber which is a cavity, and it is possible to connect a wiring member such as an FPC to the contact points by pressing the wiring member against the contact points sufficiently. Therefore, the reliability of electrical connections between the contact points and the wiring member is improved. Further, as compared to a case in which the contact points are arranged only at areas each of which does not face the cavity of one of the pressure chambers and of the common liquid chamber, the area in which the contact points can be arranged becomes wider, and it possible to arrange a large number of contact points densely without increasing the size of the overall apparatus.

DETAILED DESCRIPTION OF THE PREFERRED EMBODIMENTS

An embodiment of the present invention will be explained below. This embodiment is an example in which the present invention is applied to an ink-jet head which jets an ink onto a recording paper from a nozzle, as a liquid-droplet jetting apparatus.

Figure 1:
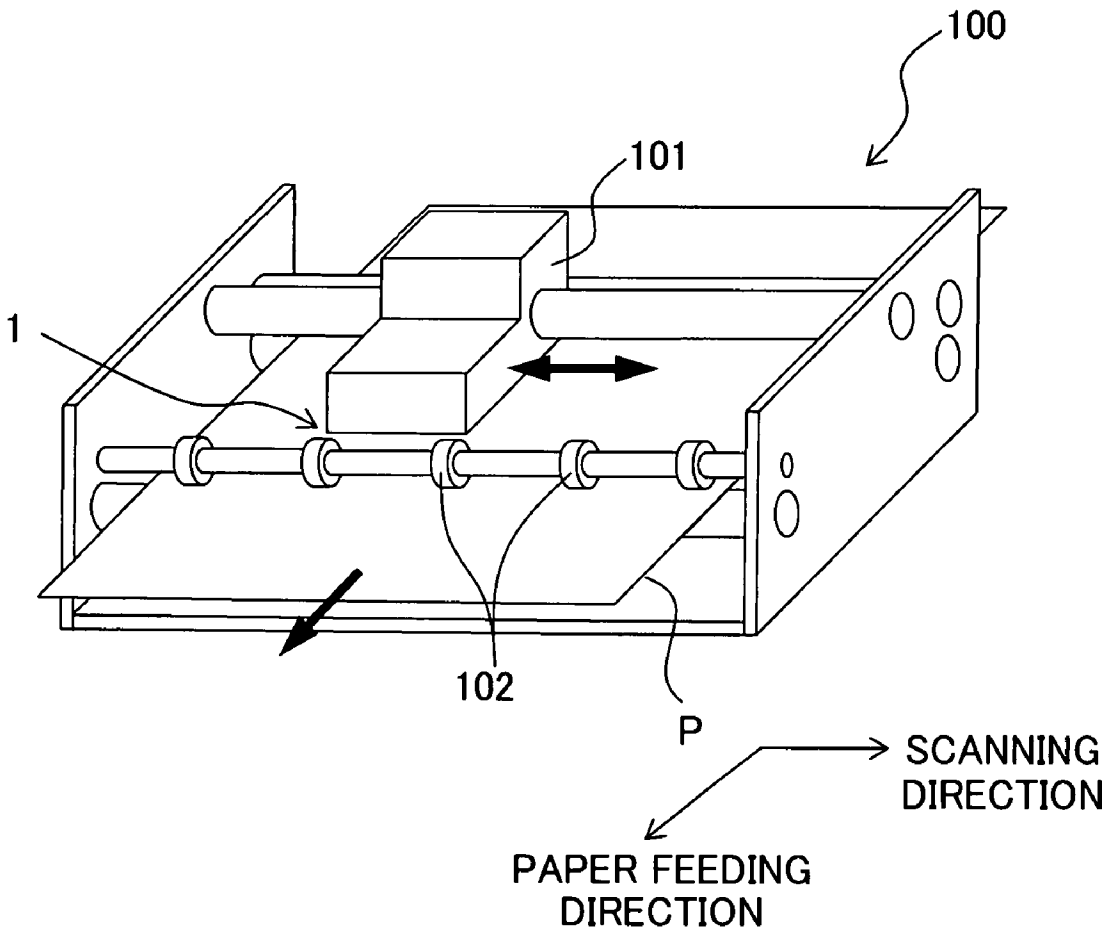
FIG. 1 is a schematic structural view of an ink-jet printer according to an embodiment of the present invention.

Firstly, an ink-jet printer 100 which includes an ink-jet head 1 will be explained below. As shown in FIG. 1, the ink-jet printer 100 includes a carriage 101 which is movable in a scanning direction (left and right direction in FIG. 1), the ink-jet head 1 of serial type which is provided on the carriage 101 and which jets the ink onto a recording paper P, and transporting rollers 102 which transport or carry the recording paper P in a paper feeding direction (forward direction) in FIG. 1. The ink-jet head 1 moves integrally with the carriage 101 in the scanning direction (left and right direction), and jets the ink onto the recording paper P from an ejecting port of a nozzle 20 which is formed on a lower surface of the ink-jet head 1 (see FIGS. 2 to 7). The recording paper P with an image or the like recorded thereon by the ink-jet head 1 is discharged in the paper feeding direction by the transporting roller 102.

Next, the ink-jet head 1 will be explained in detail. As shown in FIGS. 2 to 7, the ink-jet head 1 includes a channel unit 2 in which ink channels are formed, and a piezoelectric actuator 3 which is arranged on an upper surface of the channel unit 2.

Firstly, the channel unit 2 will be explained below. As shown in FIGS. 2 to 7, the channel unit 2 includes a cavity plate 10, manifold plates 11 and 12, and a nozzle plate 13, and these four plates 10 to 13 are joined in stacked layers. Among these four plates, the cavity plate 10 and the manifold plates 11 and 12 are stainless steel plates, and ink channels, such as a manifold 17 and a pressure chamber 14 which will be described later, can be formed easily in these three plates 10 to 12 by an etching. Further, the nozzle plate 13 is formed of a high-molecular synthetic resin such as polyimide, and is joined to a lower surface of the manifold plate 12. Alternatively, the nozzle plate 13 may also be formed of a metallic material such as stainless steel, similar to the three plates 10 to 12.

A plurality of pressure chambers 14 arranged along a plane is formed in the cavity plate 10 (pressure chamber plate), and these pressure chambers 14 are open upward. Further, the pressure chambers 14 are arranged in two rows in the paper feeding direction (up and down direction in FIG. 2), and each of the pressure chambers 14 is formed to be substantially elliptical shaped which is long in the scanning direction (left and right direction in FIG. 2), in a plan view.

As shown in FIGS. 3 to 7, communicating holes 16 and 19 are formed in the two manifold plates 11 and 12, respectively, at positions each overlapping in a plan view with one end portion of one of the pressure chambers 14. Further, nozzles 20 having a tapered shape are formed in the nozzle plate 13 at positions each overlapping in a plan view with the communicating holes 16 and 19. Each of the pressure chambers 14 communicates with one of the nozzles 20 via the communicating holes 16 and 19.

Figure 5:
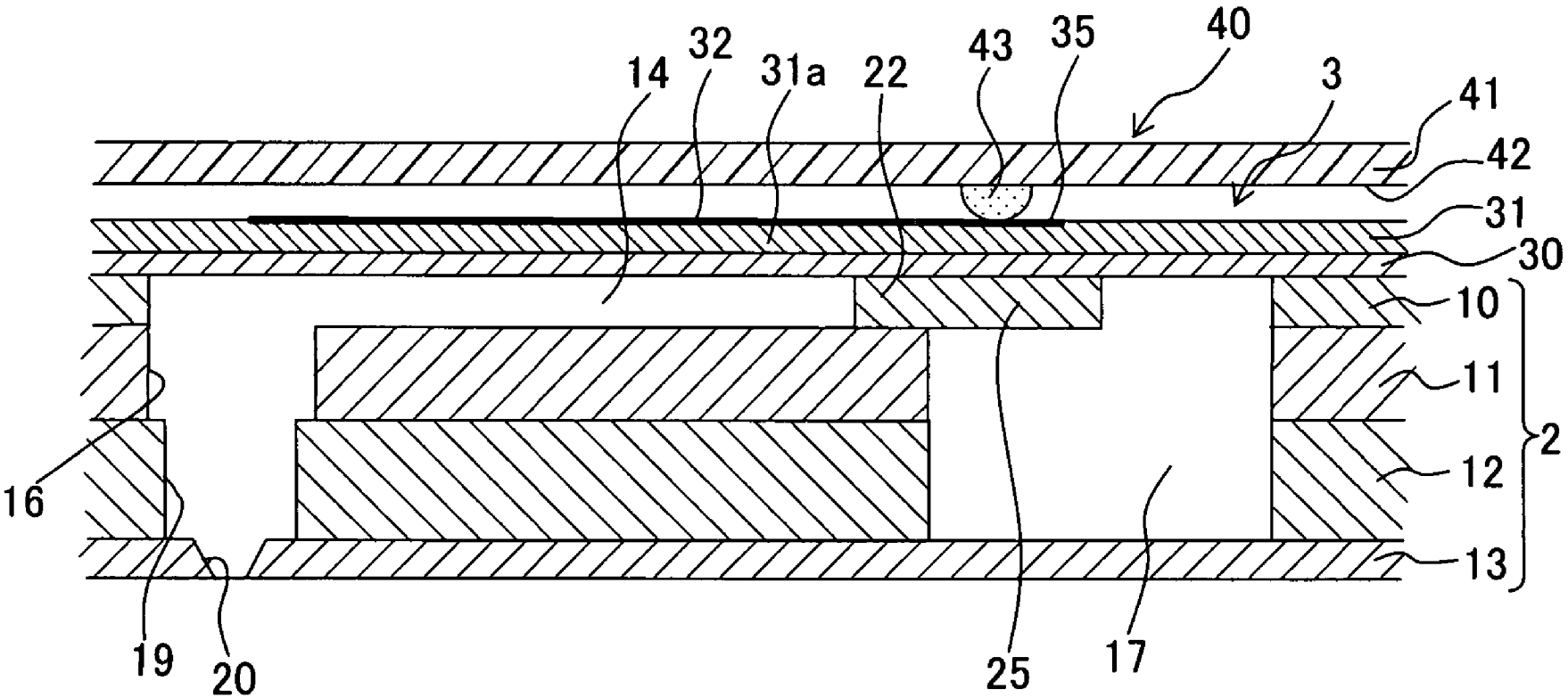
FIG. 5 is a cross-sectional view taken along a line V-V shown in FIG. 3.
Figure 6:
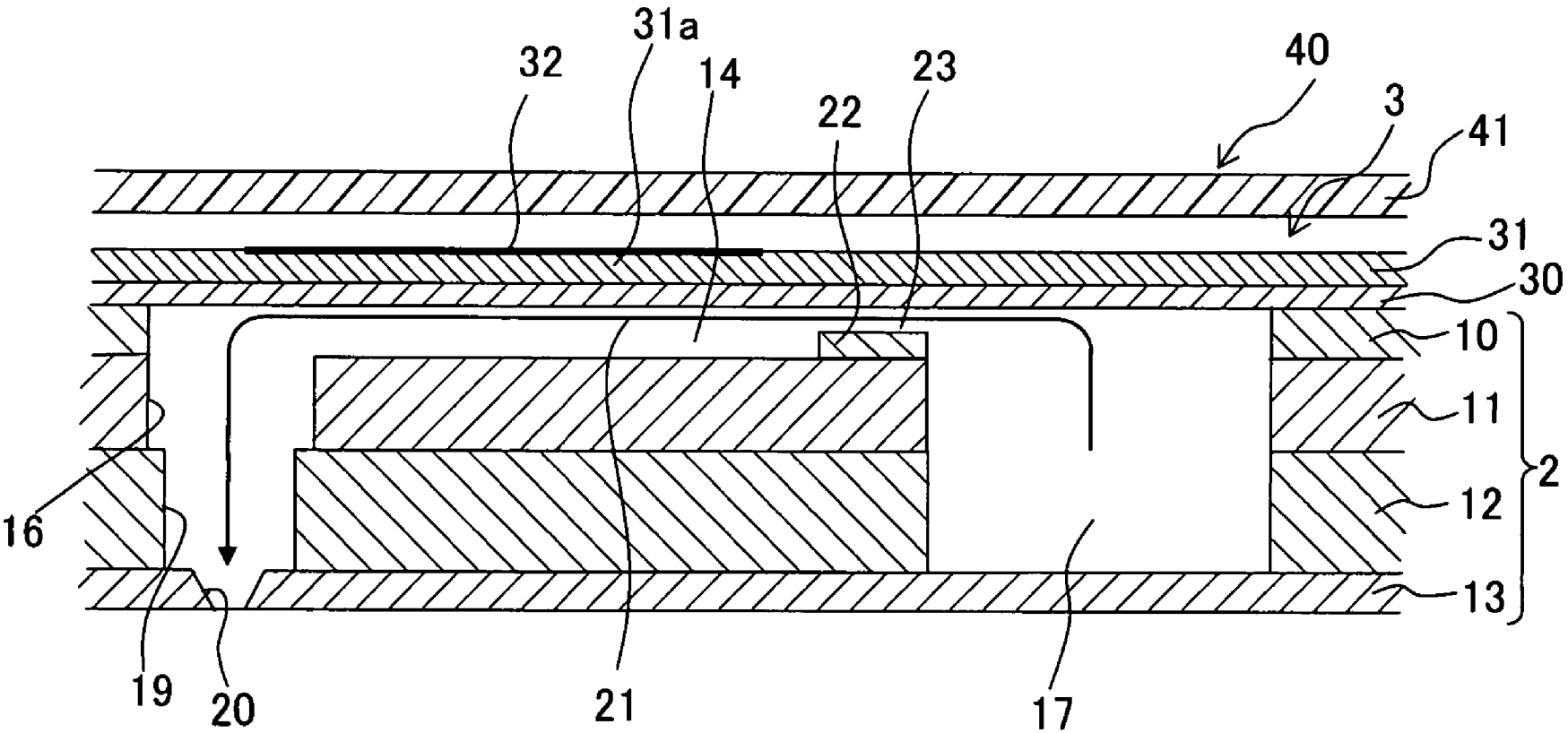
FIG. 6 is a cross-sectional view taken along a line VI-VI shown in FIG. 3.

Furthermore, two manifolds 17 (common liquid chambers, liquid chambers), each of which is extended in the paper feeding direction, are formed in the manifold plates 11 and 12 at areas on right or left side, respectively, in the scanning direction of one of rows of the pressure chambers 14. These two manifolds 17 are through holes formed in each of the three plates 10 to 13, and as shown in FIGS. 5 and 6, both top and bottom sides of each of the manifolds 17 are closed by a vibration plate 30 and a nozzle plate 13 respectively. The nozzle plate 13 and the vibration plate 30 will be described later. Moreover, the two manifolds 17 are connected to an ink tank (omitted in the diagram) via an ink supply port 18 formed in the vibration plate 30, and ink is supplied from the ink tank to these manifolds 17.

As shown in FIGS. 5 and 6, an upper portion of each of the manifolds 17 formed in the cavity plate 10 is arranged adjacent to the pressure chambers 14, in a direction of surface of the cavity plate 10 (direction along the plane on which the pressure chambers 14 are arranged). Further, as shown in FIGS. 3, 4 and 6, on upper surfaces of partition walls 22 which are formed in the cavity plate 10 and which separate the pressure chambers 14 and the manifold 17, communicating channels 23 in the form of a groove are formed, and each of the pressure chambers 14 and the manifold 17 are communicated via one of the communicating channels 23.

Thus, when a part of the manifold 17 and the pressure chambers 14 are positioned on a same plane, it is enough that the communicating channels 23 each communicating one of the pressure chamber 14 and the manifold 17 are formed parallel to this plane (plate surface), and there is no need to form the communicating channels 23 to be extended in a direction of thickness of the plate. Therefore, the shape of the ink channels becomes simple, thereby reducing the number of plates to be stacked. Therefore, it is possible to reduce the manufacturing cost of the ink-jet head 1.

Figure 3:
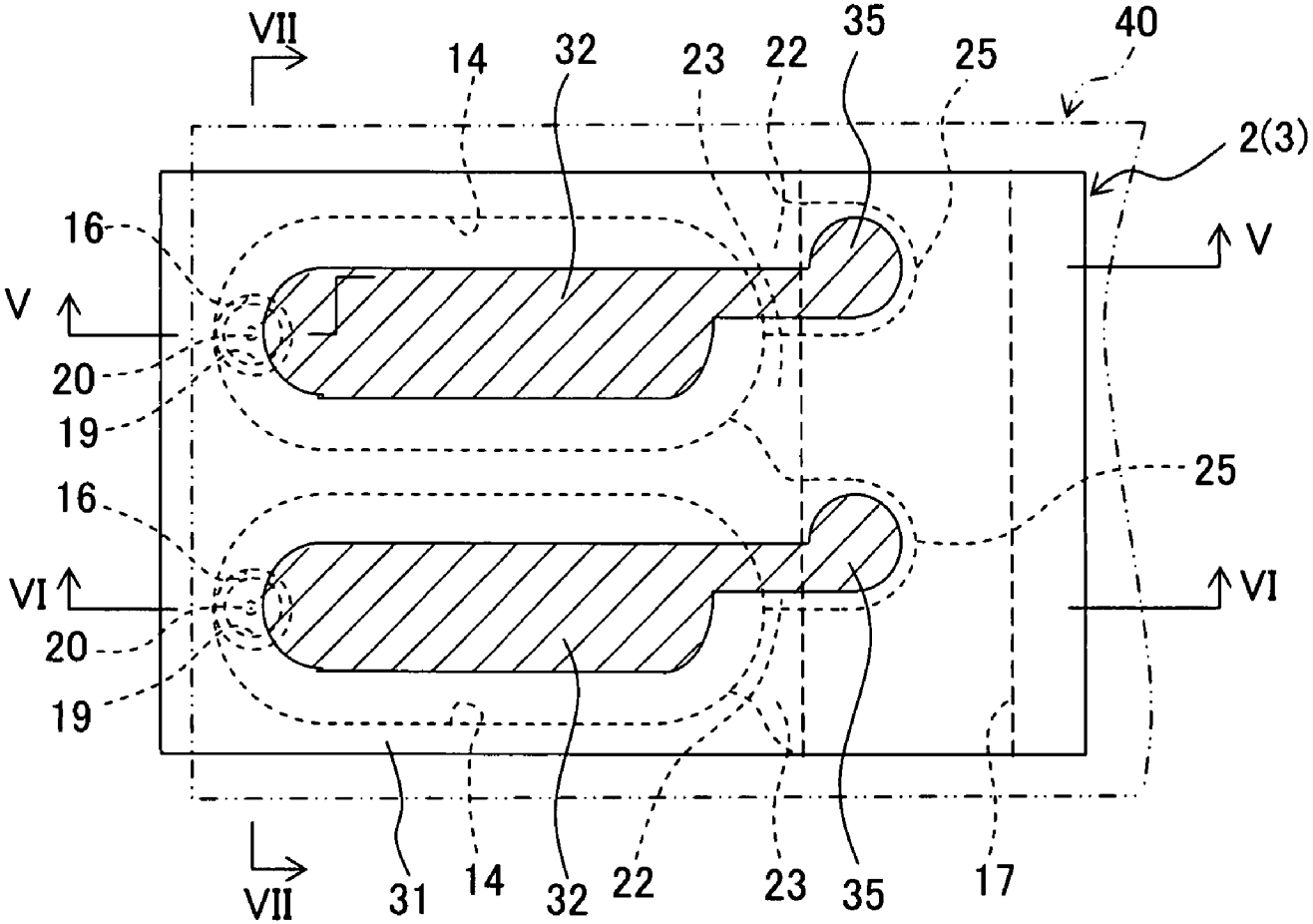
FIG. 3 is a partially enlarged view of FIG. 2.
Figure 4:
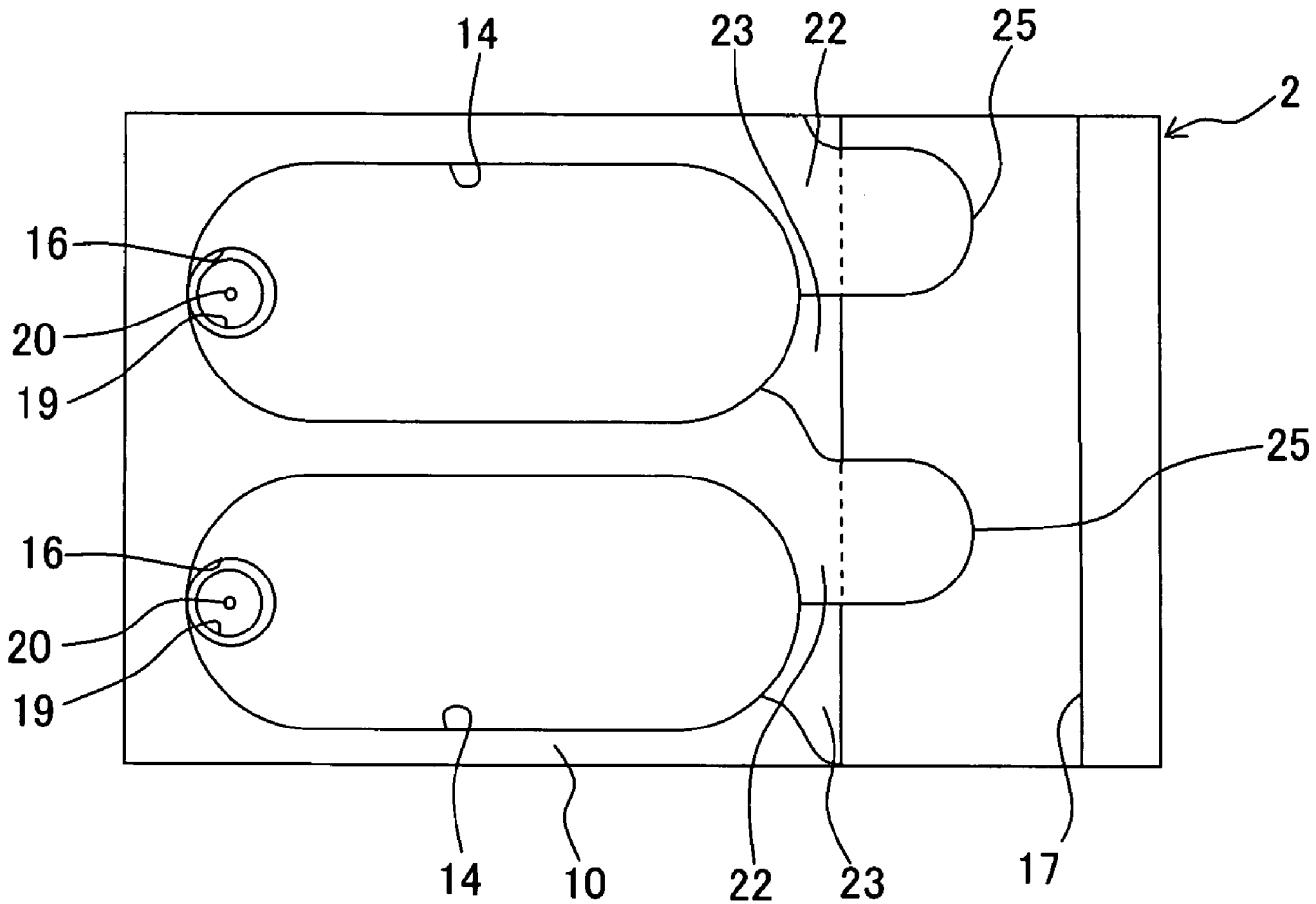
FIG. 4 is an enlarged plan view of an area of a channel unit shown in FIG. 3.

As shown in FIGS. 3 and 4, a channel width of each of the communicating channels 23 is narrowed progressively from the manifold 17 toward one of the pressure chambers 14 (channel area is decreased). Therefore, the ink is hardly stagnated in the communicating channel 23, and even when an air bubble has entered into the manifold 17, this air bubble can hardly stay or remains inside the communicating channel 23. Accordingly, it is possible to supply the ink stably to the pressure chambers 14 and the nozzles 20 disposed at the downstream. Further, the communicating channels 23 are formed by the half etching on the upper surfaces of the partition walls 22. Therefore, as compared to a case in which the communicating channels 23 are formed as through holes by a full etching, rigidity of the cavity plate 10 as a whole becomes higher, and thus handling of the cavity plate 10 during the manufacturing becomes easier. Further, when compared with a case in which the communicating channels 23 are formed by the half etching on the lower surfaces of the partition walls 22, respectively, (surface on a side opposite to the piezoelectric actuator 3) by the half etching, an air bubble hardly stays inside the communicating channels 23. A plurality of supporting sections 25 are formed on both sides in a direction of channel width of the communicating channels 23 (paper feeding direction). Each of the supporting sections 25 extends, from one of the partition walls 22 of the cavity plate 10, toward an inner side of the manifold 17, and supports an area, at which one of a plurality of contact points 35 (which will be explained later on), from a position below the contact point 35. The supporting sections 25 will be explained later in detail.

Further, as shown in FIG. 6, the manifold 17 communicates with each of the pressure chambers 14 via one of the communicating channels 23, and each of the pressure chambers 14 communicates with one of the nozzles 20 via the communicating holes 16 and 19. Thus, a plurality of individual ink channels 21 each from the manifold 17, reaching up to one of the nozzles 20 via one of the pressure chambers 14, is formed in the channel unit 2.

Next, the piezoelectric actuator 3 will be explained below. As shown in FIGS. 3 and 5 to 7, the piezoelectric actuator 3 includes a vibration plate 30 which is arranged on the upper surface of the channel unit 2, a piezoelectric layer 31 which is formed on an upper surface of the vibration plate 30, and a plurality of individual electrode 32 each of which is formed at a position, on the upper surface of the piezoelectric layer 31, facing one of the pressure chambers 14.

The vibration plate 30 is a plate having a substantially rectangular shape in a plan view, and is made of a metallic material exemplified by an iron alloy such as stainless steel, a copper alloy, a nickel alloy, a titanium alloy, or the like. As shown in FIGS. 5 and 6, this vibration plate 30 is joined to the upper surface of the cavity plate 10 in a state that the vibration plate 30 covers the pressure chambers 14 and the manifolds 17 from above. Further, the metallic vibration plate 30 is electroconductive, and is kept at a ground electric potential all the time. Furthermore, the vibration plate 30 serves also as a common electrode which generates an electric field in the piezoelectric layer 31 sandwiched between the individual electrodes 32 and the vibration plate 30.

Figure 2:
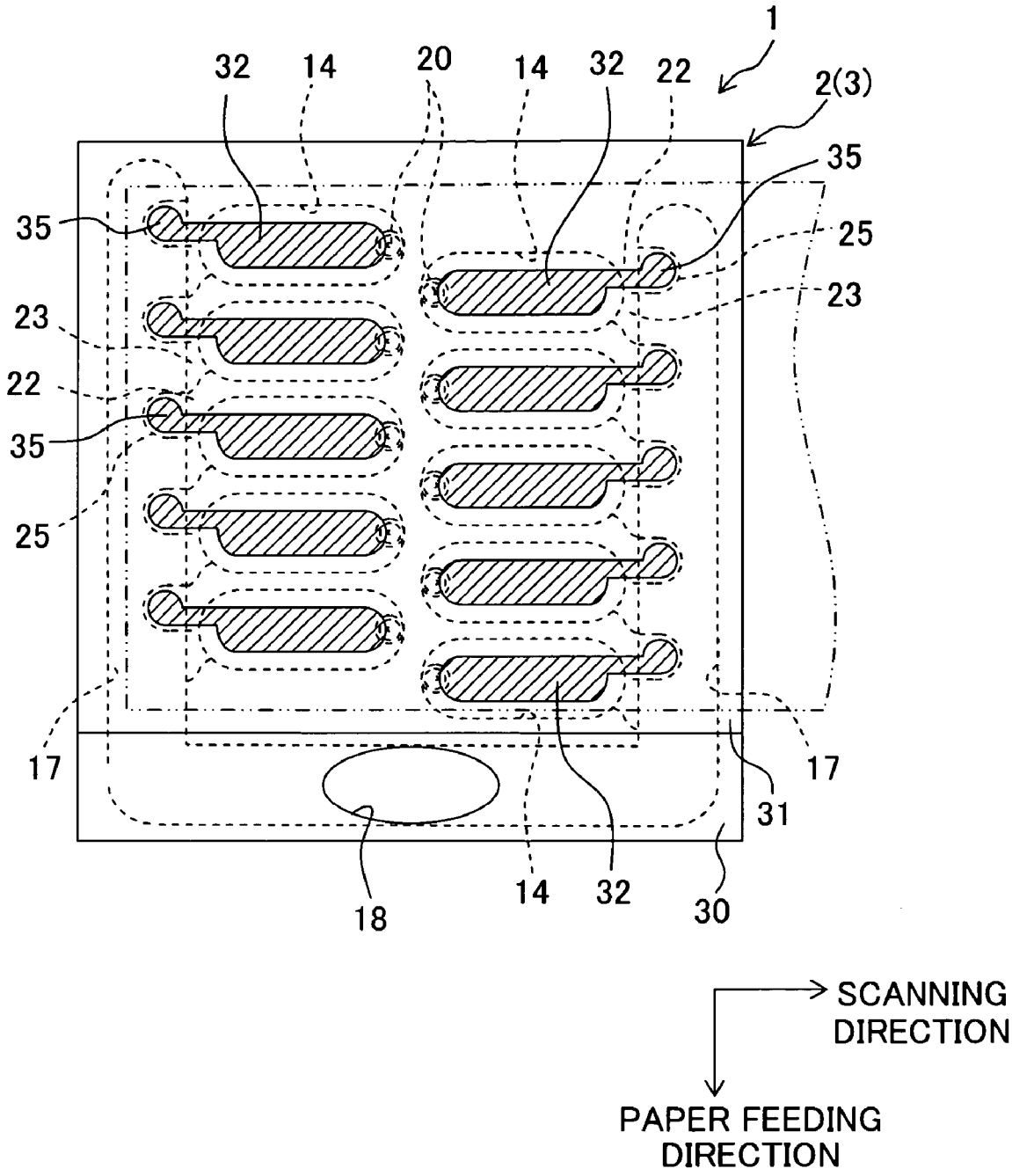
FIG. 2 is a plan view of the ink-jet head.
Figure 7:
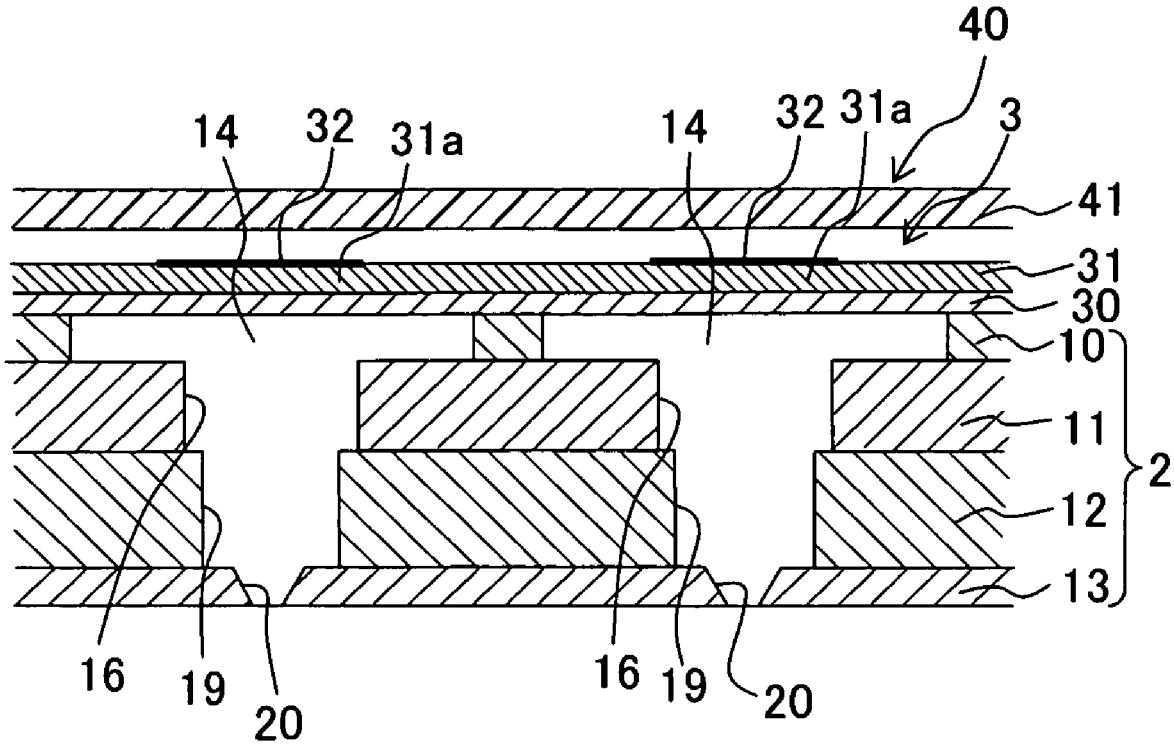
FIG. 7 is a cross-sectional view taken along a line VII-VII shown in FIG. 3.

The piezoelectric layer 31 which is composed of mainly lead zirconate titanate (PZT) is formed on the upper surface of the vibration plate 30. The PZT is a solid solution of lead titanate and lead zirconate, and is a ferroelectric substance. As shown in FIGS. 2, 3 and 7, the piezoelectric layer 31 is formed continuously on the upper surface of the vibration plate 30, so as to cover the pressure chambers 14. The piezoelectric layer 31 can be formed by using an aerosol deposition method (AD method) in which very fine particles of a piezoelectric material are jetted or blown onto a substrate and collided to the substrate at high velocity, to be deposited onto the substrate. Alternatively, the piezoelectric layer 31 can also be formed, for example, by a method such as a sputtering method, a chemical vapor deposition method (CVD method), a sol-gel method, or a hydrothermal synthesis method. Still alternatively, the piezoelectric layer 31 can also be formed by sticking, to the vibration plate 30, a piezoelectric sheet which is obtained by baking a green sheet of PZT.

On the upper surface of the piezoelectric layer 31, the individual electrodes 32 are formed. Each of the individual electrodes 32 has a substantially elliptical shape and is smaller in size to some extent than one of the pressure chambers 14. These individual electrodes 32 are formed, on the upper surface of the piezoelectric layer 31, at positions each overlapping in a plan view with a central portion of an associated pressure chamber 14 of the pressure chambers 14. Further, each of the individual electrodes 32 is made of an electroconductive material such as gold, copper, silver, palladium, platinum, titanium, or the like.

Furthermore, on the upper surface of the piezoelectric layer 31, the contact points 35 are formed. Each of the contact points 35 is drawn from an end portion, of one of the individual electrodes 32, at a side of the manifold 17, in parallel with a longitudinal direction (left and right direction in FIG. 2) of one of the individual electrodes 32, up to an area facing the manifold 17. These contact points 35 are exposed to an outside. Each of the contact points 35 has a circular shape, and is arranged such that a center of the contact point 35 is slightly shifted or misaligned, from a center line extended in a longitudinal direction of one of the individual electrodes 32 to which the contact point 35 correspond, toward one side in a width direction (for example, upper side in FIG. 2) of the corresponding individual electrode 32. The individual electrodes 32 and the contact points 35 can be formed by a method such as a screen printing, the sputtering method, a vapor deposition method, or the like.

As shown in FIG. 5, a Flexible Printed Circuit (FPC) 40 is connected to the contact points 35. The FPC 40 includes a substrate 41 made of a synthetic resin material such as polyimide, a plurality of wires 42 formed on a lower surface of the substrate 41, and a plurality of bumps 43 each formed at a tip of one of the wires 42 so as to project downwardly. Further, the contact points 35 arranged on the upper surface of the piezoelectric layer 31 are joined to the bumps 43 of the FPC 40, respectively, by a solder or the like, thereby electrically connecting the individual electrodes 32 to a driving circuit (omitted in the diagram) via the FPC 40. A drive voltage is applied selectively to a desired individual electrode 32 from the driving circuit via the FPC 40.

Next, an action of the piezoelectric actuator 3 at the time of jetting the ink will be explained below. When the drive voltage is applied from the driving circuit selectively to the individual electrodes 32, there is a difference in an electric potential of a certain individual electrode 32, which is disposed above the piezoelectric layer 31 and to which the drive voltage is supplied, and an electric potential of the vibration plate 30 as a common electrode which is disposed below the piezoelectric layer 31 and which is kept at the ground electric potential, and thus an electric field in a direction of thickness of the piezoelectric layer 31 is generated in a portion of the piezoelectric layer 31 (drive portion 31*a*) sandwiched between the certain individual electrode 32 and the vibration plate 30. Here, when a direction in which the piezoelectric layer 31 is polarized and a direction of the electric field are the same, the driving portion 31*a* is elongated in the direction of thickness which is a direction of polarization, and is contracted in a horizontal direction. At this time, with contracting deformation of the piezoelectric layer 31, the vibration plate 30 is deformed to project toward the pressure chamber 14 so as to decrease a volume inside the pressure chamber 14, thereby applying a pressure to the ink inside the pressure chamber 14 to jet a droplets of ink from a nozzle 20 communicating with the pressure chamber 14.

Upon connecting the above-described FPC 40 to the contact points 35, the bumps 43 and the contact points 35 are joined by solder or the like while pressing the bumps 43 against the contact points 35 respectively. However, when the contact points 35 are arranged in the piezoelectric actuator 3 at an area (on the upper surface of the piezoelectric layer 31) which faces cavities such as the pressure chamber 14 and one of the manifolds 17, the rigidity of the piezoelectric actuator 3 is low at the area thereof in which the contact points 35 are arranged. Therefore, the bumps 43 cannot be pressed with sufficient pressure against the contact points 35, and there is a fear that the reliability of electrical connection between the bumps 43 and the contact points 35 is lowered. On the other hand, an area, of the piezoelectric actuator 3, which does not face the cavities such as the pressure chamber 14 and the manifold 17, is not very wide. Accordingly, when an attempt is made to arrange the contact points 35 only in such area, it is difficult to arrange densely a large number of the contact points 35, and thus the size of the ink-jet head 1 becomes great.

In view of this, in the ink-jet head 1 of this embodiment, the contact points 35 are drawn up to an area, on the upper surface of the piezoelectric layer 31, which faces one of the manifolds 17. Furthermore, the supporting sections 25, formed in the cavity plate 10 corresponding to the contact points 35 and the pressure chamber 14 respectively, are arranged at positions facing the contact points 35, respectively, and the supporting sections 25 support (reinforce) from below the vibration plate 30 and the piezoelectric layer 31, at the areas in which the contact points 35 are arranged.

As shown in FIGS. 3 to 5, each of the supporting sections 25, while making a contact with a lower surface of the vibration plate 30 (surface on a side of the manifold 17), is extended, from a side surface on the side of the manifold 17, of one the partition walls 22 which partitions one of the pressure chambers 14 and one of the manifold 17 to both of which the supporting section 25 corresponds, toward one side (right side in FIG. 3) in the scanning direction, and is projected in a plan view up to a central portion in a width direction of the manifold 17. Further, a shape of a tip of each of the supporting sections 25 is circular shape which is greater in size to some extent than one of the circular shaped contact points 35, and the contact point 35 is entirely overlapped in a plan view with the supporting section 25. Therefore, the rigidity of the area of the piezoelectric layer 31 and the vibration plate 30 in which the contact points 35 are formed, becomes high in spite that the area faces the manifold 17 which is a cavity, and it is possible to connect the FPC 40 to the contact points 35 by pressing with a sufficient pressure. Therefore, the reliability of the electrical connections between the contact points 35 and the bumps 43 of the FPC 40 is improved. Further, since the area in which the contact points 35 can be arranged becomes wider as compared to a case in which the contact points 35 are arranged only in an area not facing the cavities such as the pressure chambers 14 and the manifold 17, it is possible to arrange densely the large number of contact points 35 without increasing the overall size of the apparatus. Furthermore, as shown in FIGS. 3 and 4, since the tip of each of the supporting section 25 is formed, in a plan view, to have a shape similar to the circular shaped contact point 35 but slightly bigger than the contact point 35, it is possible to overlap the contact point 35 completely with the supporting section 25 without unnecessarily increasing an area of the tip of the supporting section 25, and to secure the reliability of connection between the contact points 35 and the FPC 40. In addition, the tip of the supporting section 25 is formed to be circular arc shaped. Accordingly, when the FPC 40 is pressed against the contact points 35, it is possible to distribute a stress generated in a point of contact with the vibration plate 30 at an outer edge of each of the supporting sections 25, thereby reducing the concentration of the stress at one point.

Further, as shown in FIGS. 3 and 4, each of the supporting sections 25 is extended toward the manifold 17 in an upstream portion in the paper feeding direction (upper portion in FIG. 3), of one of the partition walls 22 separating the pressure chambers 14 and the manifold 17. In other words, corresponding to the contact points 35 each shifted, with respect to one of the individual electrodes 32, toward the upstream side in the paper feeding direction of the contact point 35, each of the supporting sections 25 is also shifted, with respect to one of the pressure chambers 14, toward the upstream side in the paper feeding direction. Further, the above-described communicating channels 23 each of which communicates the manifold 17 and one of the pressure chambers 14, are formed each on the upper surface, of one of the partition walls 22, at a downstream side portion in the paper feeding direction of the partition wall 22. Consequently, between a supporting section 25 corresponding to a certain pressure chamber 14 of the pressure chambers 14 and another supporting section 25 corresponding to another pressure chamber 14 adjacent to the certain pressure chamber 14, a communicating channel 23 communicating the certain pressure chamber 14 and the manifold 17 is arranged. In other words, the communicating channel 23 communicating the certain pressure chamber 14 and the manifold 17 is sandwiched between the supporting section 25 corresponding to this pressure chamber 14 and the supporting section 25 corresponding to the adjacent pressure chamber 14. Therefore, regarding two pressure chambers 14 which are mutually adjacent, when a pressure is applied by the piezoelectric actuator 3 to the ink in a certain pressure chamber 14 of the adjacent pressure chambers 14, propagation of a pressure wave generated in this pressure chamber 14 to the manifold 17 via the communicating channel 23 and further the propagation of the pressure wave to another pressure chamber 14 adjacent to the certain pressure chamber via the manifold (fluid cross-talk) is suppressed by supporting sections 25 which are projected into the manifold 17 at both sides, respectively, of the communicating channel 23 corresponding to the certain pressure chamber 14. Therefore, a variation in jetting characteristics due to a drive pattern of the pressure chambers 14 becomes smaller, thereby improving a printing quality.

Both of the supporting sections 25 and the communicating channels 23 are formed in the cavity plate 10. Therefore, it is possible to form the supporting sections 25, the communicating channels 23, and the pressure chambers 14 at a time by the etching, and to reduce the manufacturing cost of the ink-jet head 1.

Next, modified embodiments in which various changes are made to the embodiment will be explained. Same reference numerals will be given to parts or components having similar construction as those in the embodiment, and explanation therefor will be omitted as appropriate.

First Modified Embodiment

Figure 8:
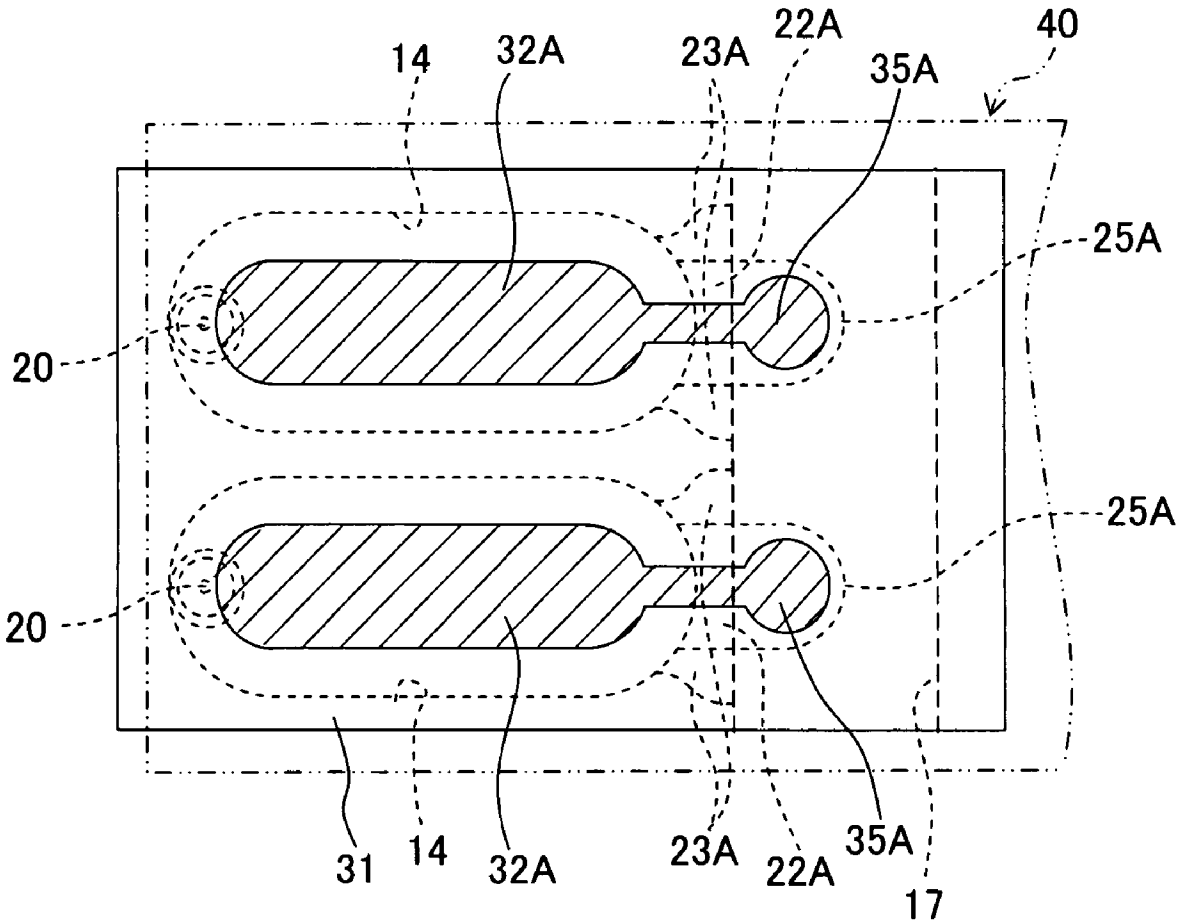
FIG. 8 is an enlarged plan view of a first modified embodiment, corresponding to FIG. 3.

In the embodiment, the structure is such that for one pressure chamber 14, the ink flows in from one communicating channel 23, (see FIG. 3). However, a structure may be adopted such that the ink flows into one pressure chamber from two communicating channels. For example, as shown in FIG. 8, a plurality of contact points 35A are drawn, on the upper surface of the piezoelectric layer 31, from a plurality of individual electrodes 32A respectively, up to an area facing the manifold 17 along a center line extending in the scanning direction (left and right direction in FIG. 8) of the individual electrodes 32A. On the other hand, a plurality of supporting sections 25A are formed in a cavity plate, such that the supporting sections 25A are extend from partition walls 22A, respectively, separating the pressure chambers 14 and the manifold 17, and to project up to positions each facing one of the contact points 35A. Further, two communicating channels 23A are formed on two sides, respectively, of each of the supporting sections 25A, with respect to the paper feeding direction (up and down direction in FIG. 8). According to this structure, since the ink flows into one pressure chamber 14 from the manifold 17 through two communicating channels 23A, the ink is hardly stagnated in the pressure chamber 14, and even when an air bubble enters into the pressure chamber 14, the air bubble hardly remains or stays in the pressure chamber 14.

Second Modified Embodiment

Figure 9:
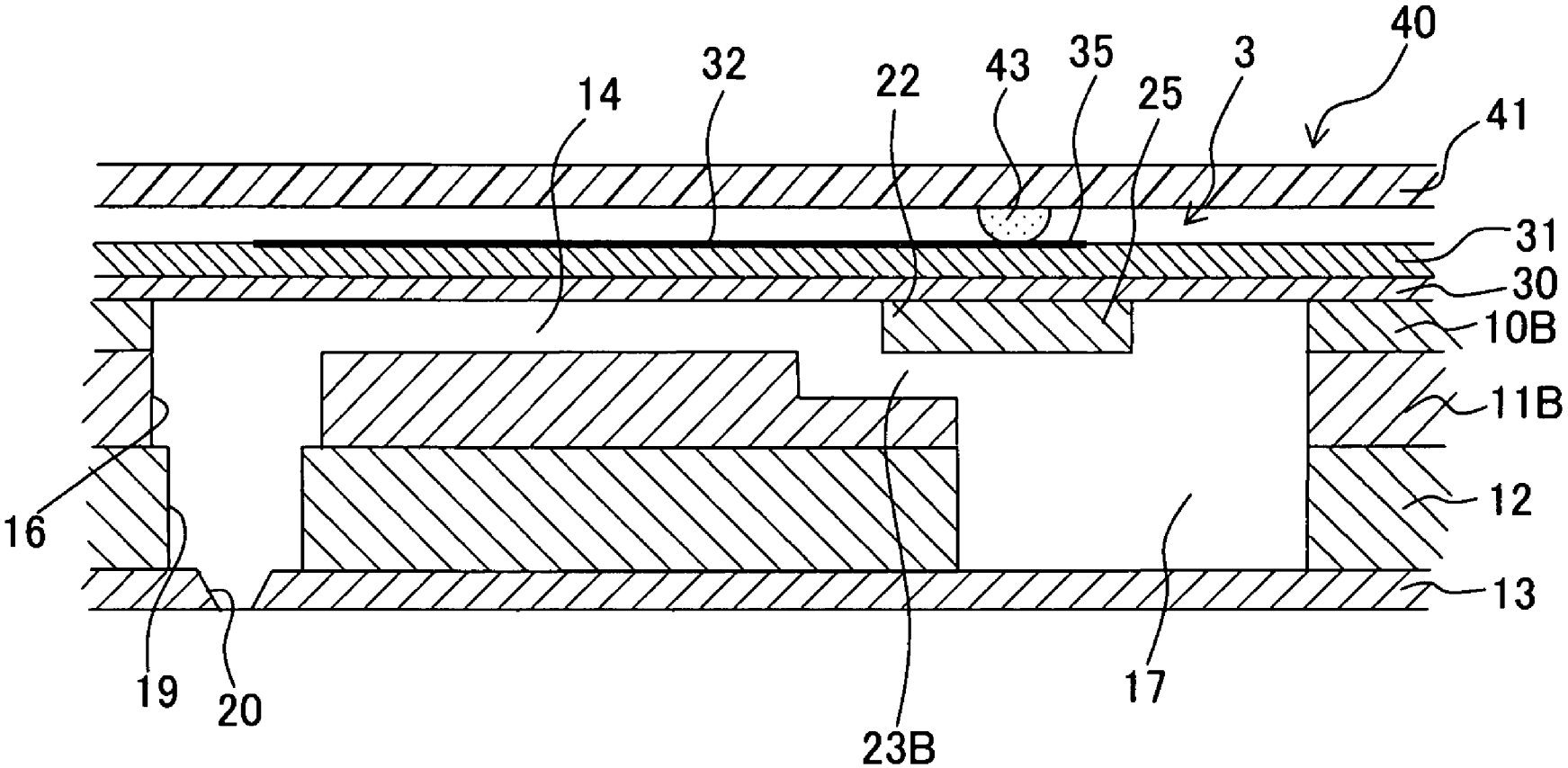
FIG. 9 is a cross-sectional view of a second modified embodiment, corresponding to FIG. 5.

It is not necessarily indispensable that the communicating channels communicating the pressure chambers and the manifold are formed in the cavity plate in which the pressure chambers and the supporting sections are formed, and the communicating channels may be formed in a plate other than the cavity plate. For example, as shown in FIG. 9, a communicating channel 23B may be formed on an upper surface of a manifold plate 11B which is in contact with a lower surface of a cavity plate 10B (surface on a side opposite to the piezoelectric actuator 3). Thus, when the communicating channel 23B is formed on the plate 11B which is a different plate from the cavity plate 10B on which the supporting section 25 is formed, a position of the communicating channel 23B is not constrained by the supporting section 25. Therefore, as in FIG. 9, the degree of freedom of designing becomes higher such that, for example, it is possible to arrange the communicating channel 23B below the supporting section 25.

Third Modified Embodiment

Figure 10:
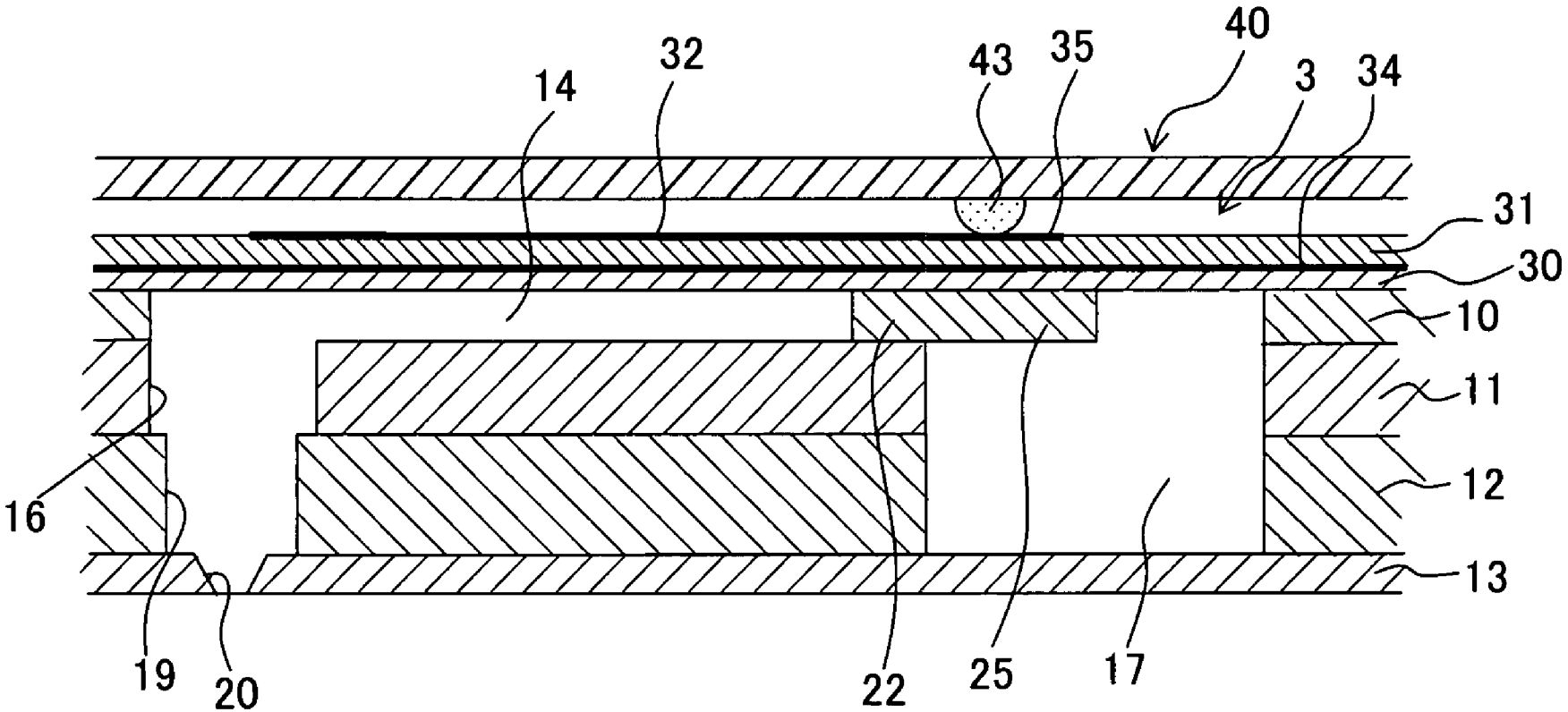
FIG. 10 is a cross-sectional view of a third modified embodiment, corresponding to FIG. 5.

It is not necessarily indispensable that the vibration plate 30 serves also as the common electrode as in the piezoelectric actuator 3 of the above-described embodiment. As shown in FIG. 10, a common electrode 34 and the vibration plate 30 may be provided separately. When the vibration plate 30 is a metallic plate, however, the vibration plate 30 and the common electrode 34 are required to be insulated by an insulating layer made of a ceramics material, a synthetic resin material, or the like. On the other hand, when the vibration plate 30 is made of an insulating material, the common electrode 34 is formed directly on the upper surface of the vibration plate 30.

Fourth Modified Embodiment

The piezoelectric actuator 3 of the above-described embodiment is a unimorph actuator which includes the vibration plate 30 and the piezoelectric layer 31 formed on one surface of the vibration plate 30. However, it is not necessarily indispensable that the actuator is limited to the unimorph actuator. Alternatively, the piezoelectric actuator may be a stacked-layered actuator having a plurality of piezoelectric layers stacked in a laminated form and arranged directly on an upper surface of the cavity plate. For example, a piezoelectric actuator 3D shown in FIG. 11 includes a plurality of stacked piezoelectric layers 31D, and a plurality of individual electrodes 32D and a plurality of common electrodes 34D arranged alternately between the piezoelectric layers 31D. The piezoelectric layers 31D are formed continuously on the upper surface of the cavity plate 10 so as to cover the pressure chambers 14.

Individual electrodes 32D and common electrodes 34D are formed on both surfaces, respectively, of the piezoelectric layers 31D, at an area overlapping with a central portion of one of the pressure chambers 14. However, no electrode is provided on the lower surface of the lowermost piezoelectric layer 31D. Further, the individual electrodes 32D are conducted with each other and the common electrodes 34D provided corresponding to one of the pressure chambers 14 are conducted with each other in an area not shown in the diagram. Furthermore, the common electrodes 34D are kept at the ground electric potential all the time. On the other hand, a contact point 35D which is exposed to an outside is connected to an individual electrode 32D included in the individual electrodes 32D and positioned on an upper surface of the uppermost piezoelectric layer 31D, and this contact point 35D is drawn on the upper surface of the uppermost piezoelectric layer 31D, from an end portion on a side of the manifold 17 of the individual electrode 32A, up to an area facing the manifold 17. A bump 43 of the FPC 40 is joined to this contact point 35D, and the drive voltage from the driving circuit is applied, via the FPC 40 and the contact point 35D, simultaneously to the individual electrode 32D arranged on the upper surface of the uppermost piezoelectric layer 31D and the individual electrodes 32D arranged in the piezoelectric layers 31D arranged below the uppermost piezoelectric layer 31D corresponding to each of the pressure chambers 14.

When the drive voltage is applied simultaneously to the individual electrodes 32D corresponding to a certain pressure chamber 14, the electric field in a direction of thickness of the piezoelectric layers 31D is generated in the piezoelectric layers 31D between the individual electrodes 32D and the common electrodes 34D. Here, when the direction in which the piezoelectric layers 31D are polarized and the direction of the electric field are same, the piezoelectric layers 31D are elongated in the direction of thickness which is the direction in which the piezoelectric layers 31D are polarized. Further, all the piezoelectric layers 31D are elongated in the direction of thickness so as to change the volume of the pressure chamber 14 covered by the piezoelectric layers 31D, thereby applying the pressure to the ink in the pressure chamber 14.

Figure 11:
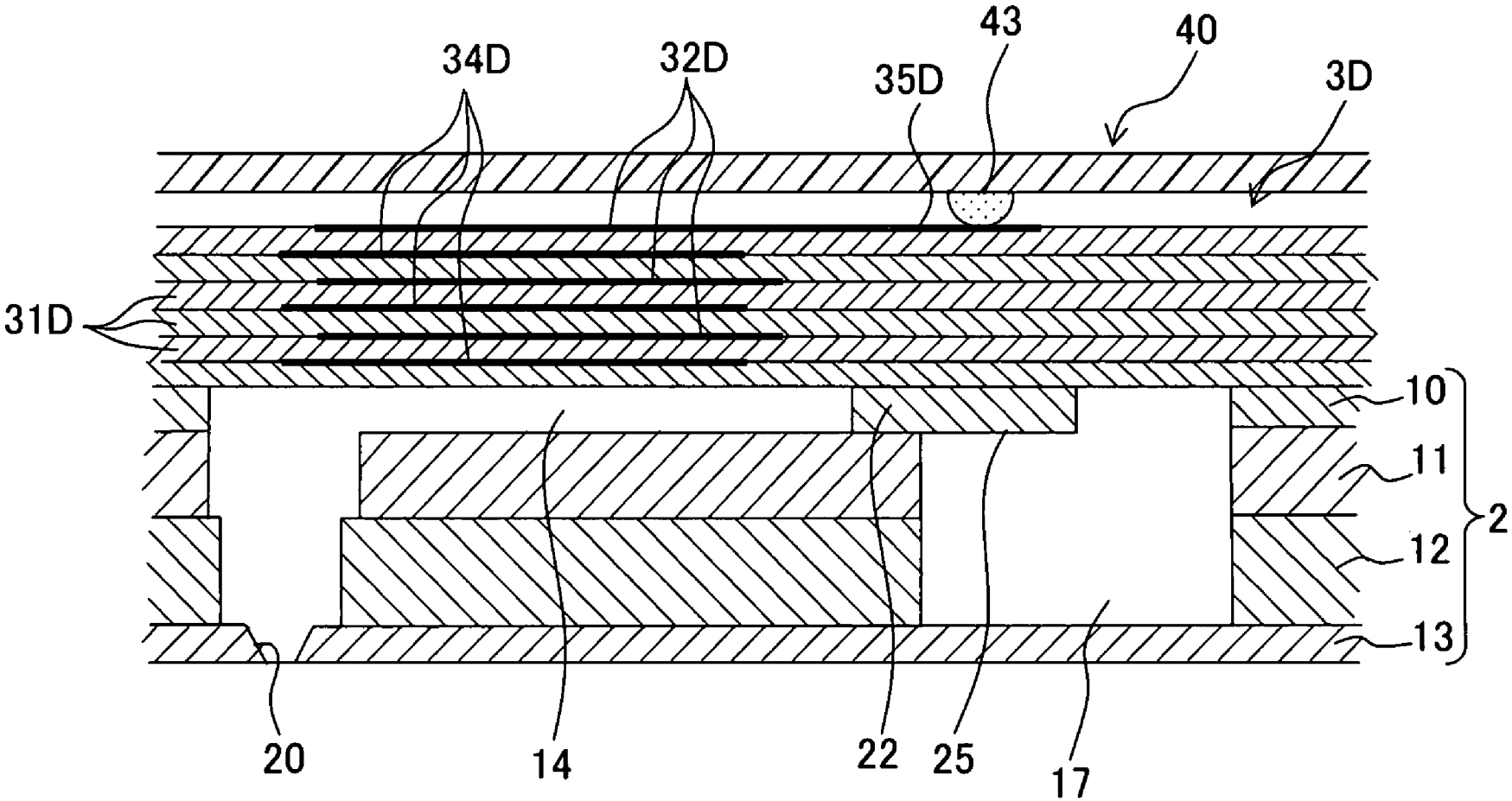
FIG. 11 is a cross-sectional view of a fourth modified embodiment, corresponding to FIG. 5.

Also in the fourth modified embodiment, as shown in FIG. 11, the cavity plate 10 is provided with a supporting section 25 projected, from one of the partition walls 22 separating the pressure chambers 14 and the manifold 17, up to a position facing the contact point 35D. Further, this supporting section 25 is in contact with the lower surface of the lowermost piezoelectric layer 31D. Consequently, the piezoelectric layers 31D is supported from below by the supporting section 25 at the area in which the contact point 35D is arranged, the rigidity of this piezoelectric layer 31D becomes high in this area. Accordingly, upon connecting the FPC 40 and the contact point 35D, it is possible to join the bump 43 of the FPC 40 by pressing the bump 43 sufficiently against the contact point 35D.

In the fourth modified embodiment, the individual electrode 32D is arranged on the upper surface of the uppermost piezoelectric layer 31D. However, a common electrode 34D may be arranged on the upper surface of the piezoelectric layer 31D. In this case, no individual electrode 32D is exposed to the outside, but when the contact point 35D, connected to the individual electrode 32D, is drawn up to the upper surface of the uppermost piezoelectric layer 31D so as to expose the contact point 35D to the outside, it is possible to connect the contact point 35D and the FPC 40 on the upper surface of the uppermost piezoelectric layer 31D.

Fifth Modified Embodiment

Figure 12:
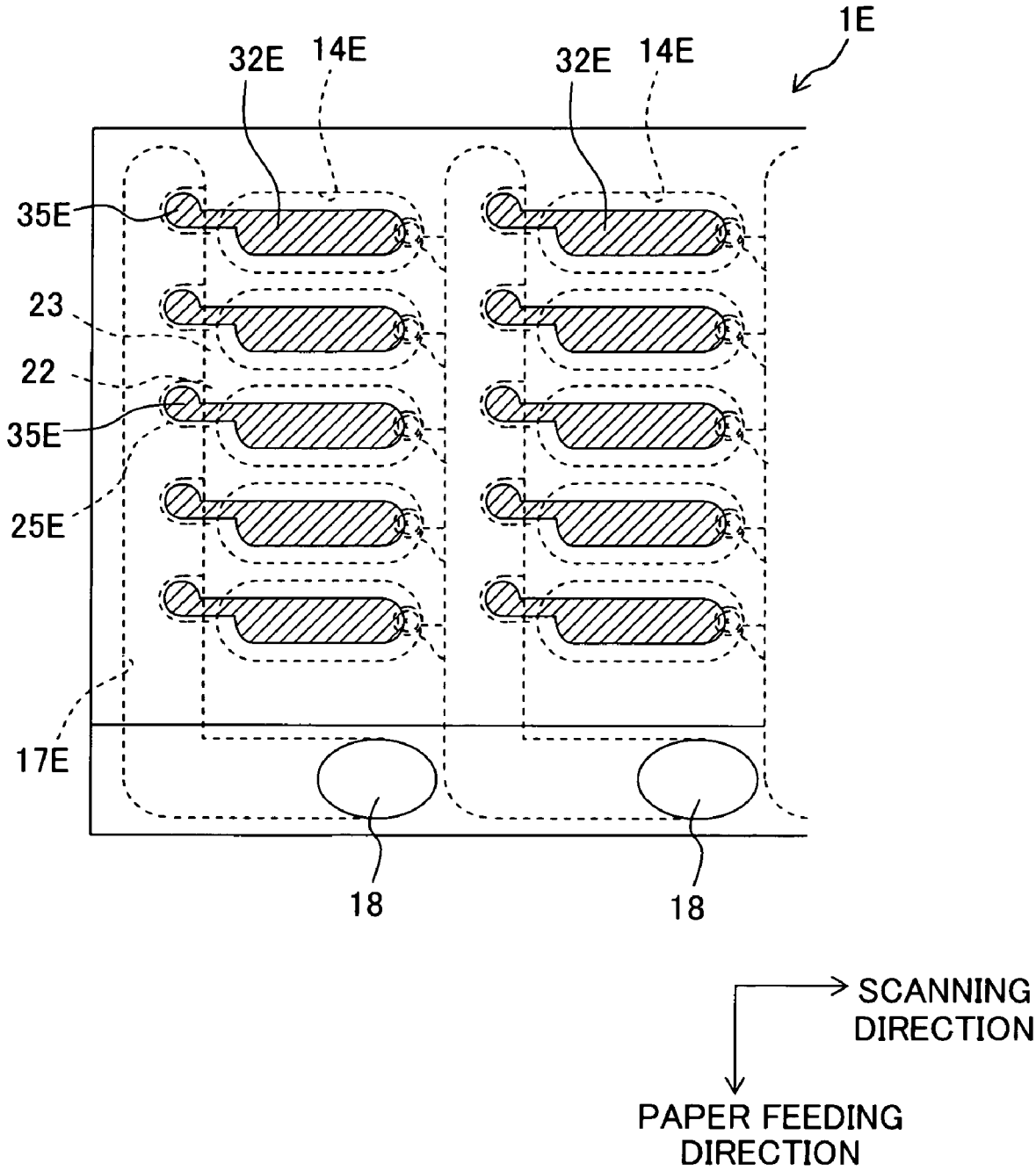
FIG. 12 is a plan view of a fifth modified embodiment, corresponding to FIG. 2.

An ink-jet head 1E of a fifth modified embodiment has a structure similar to that of the ink-jet head 1 of the first embodiment, except that a plurality of manifolds is formed and that a manifold communicating with a certain pressure chamber corresponding to a certain individual electrode differs from another manifold overlapping with a contact point connected to the certain individual electrode. In other words, in the embodiment and the modified embodiments described above, a supporting section which supports a contact point connected to a certain individual electrode is extended, from a partition wall separating a pressure chamber corresponding to the certain individual electrode and the manifold communicating with this pressure chamber, toward the inner side of the manifold. In other words, in the embodiment and the modified embodiments described above, a contact point which is connected to a certain individual electrode formed to correspond to a certain pressure chamber is formed at a position overlapping with a manifold communicating with that pressure chamber. However, It is not necessarily indispensable that a manifold overlapping with a certain contact point, and a pressure chamber corresponding to a certain individual electrode connected to the certain contact point are communicated with each other. Instead, as shown in FIG. 12 for example, a contact point 35E may be formed on an upper surface of a piezoelectric layer 31E at a position overlapping with one of manifolds 17E not communicating with a certain pressure chamber 14E corresponding to a certain individual electrode 32E to which the certain contact point 35E is connected; and a supporting section 25E may be formed inside the manifold 17E at a position overlapping with the contact point 35E. In this manner, by arranging the contact points 35E such that a certain contact point 35E is arranged at a position overlapping with a manifold which is adjacent to or different from another manifold with which a pressure chamber corresponding to an individual electrode to which the certain contact point 35E is connected, it is possible to increase the degree of freedom of arranging the contact points.

In the embodiment and the modified embodiments, the number, the shape, and the arrangement of pressure chambers and manifolds are arbitrary, and the shape and the size of the contact points and of the supporting sections are also arbitrary.

Each of the embodiment and the modified embodiments of the as explained above is an example in which the present invention is applied to the ink-jet head which jets the ink from a nozzle. However, in addition to the ink-jet head, the present invention is also applicable to a liquid-droplet jetting apparatus which jets a liquid other than ink, such as a reagent, a biomedical solution, a wiring-material solution, an electronic-material solution, a cooling medium (refrigerant), a fuel, and the like. Further, the present invention is also applicable to a liquid transporting apparatus which transports a liquid to a predetermined position, without being limited to an apparatus which jets a liquid.

What is claimed is:

1. A liquid-droplet jetting apparatus which jets a liquid droplet, comprising:

a channel unit which includes a plurality of nozzles; a plurality of pressure chambers arranged along a plane and communicating with the nozzles respectively; and a common liquid chamber arranged along the plane and adjacent to the pressure chambers; and a piezoelectric actuator which is arranged on one surface of the channel unit so as to cover the pressure chambers, and extended from an area above the channel unit and facing the pressure chambers up to another area above the channel unit and facing the common liquid chamber; which applies a pressure to a liquid in the pressure chambers by selectively changing volumes of the pressure chambers; and which includes: a piezoelectric layer arranged at the area facing the pressure chambers; a plurality of individual electrodes which are arranged on one surface of the piezoelectric layer, at the area facing the pressure chambers so as to correspond to the pressure chambers respectively; a common electrode arranged on the other surface of the piezoelectric layer; and a plurality of contact points which are connected to the individual electrodes respectively, and are exposed on the one surface of the piezoelectric layer, on a side opposite to the pressure chambers and the common liquid chamber;

wherein each of the contact points is drawn, on the one surface of the piezoelectric layer on the side opposite to the pressure chambers and the common liquid chamber, from one of the individual electrodes up to the another area facing the common liquid chamber; and the channel unit is provided with a plurality of supporting sections which are formed in the channel unit, which are in contact with a surface of the piezoelectric actuator on a side of the common liquid chamber, and which are extended from an inner surface of the common liquid chamber up to positions each facing one of the contact points.

2. The liquid-droplet jetting apparatus according to claim 1, wherein:

the supporting sections are projected, toward an inner side of the common liquid chamber, from partition walls, respectively, which separate the pressure chambers and the common liquid chamber; and communicating channels are formed, each between a supporting section, which is included in the supporting sections and which corresponds to a pressure chamber included in the pressure chambers, and another supporting section corresponding to another pressure chamber adjacent to the pressure chamber, so as to communicate the pressure chamber and the common liquid chamber.

3. The liquid-droplet jetting apparatus according to claim 2, wherein a channel area of each of the communicating channels is narrowed from the common liquid chamber toward one of the pressure chambers.

4. The liquid-droplet jetting apparatus according to claim 2, wherein:

the channel unit has a plurality of stacked plates including a pressure chamber plate in which the pressure chambers are formed; and the supporting sections and the communicating channels are formed in the pressure chamber plate.

5. The liquid-droplet jetting apparatus according to claim 4, wherein the communicating channels are formed by a half etching on a surface of the pressure chamber plate on which the piezoelectric actuator is arranged.

6. the liquid-droplet jetting apparatus according to claim 2, wherein:

a shape of tips of the supporting sections is substantially same as a shape of the contact points to which the supporting sections face respectively; and a size of the tips of the supporting sections is greater than a size of the contact points to which the supporting sections face respectively, and each of the contact points overlaps entirely with one of the supporting sections as viewed from a direction orthogonal to the plane.

7. The liquid-droplet jetting apparatus according to claim 6, wherein the shape of the tips of the supporting sections is a circular arc.

8. The liquid-droplet jetting apparatus according to claim 1, wherein:

the supporting sections are projected, toward an inner side of the common liquid chamber, from partition walls, respectively, which separate the pressure chambers and the common liquid chamber; and two communicating channels are formed on both sides, respectively, of a supporting section included in the supporting sections and corresponding to a pressure chamber included in the pressure chambers so as to communicate the pressure chamber and the common liquid chamber.

9. The liquid-droplet jetting apparatus according to claim 1, wherein;

the channel unit has a plurality of stacked plates including a pressure chamber plate in which the pressure chambers are formed;

the supporting sections are projected, in the pressure chamber plate, toward an inner side of the common liquid chamber from walls, respectively, which separate the pressure chambers and the common liquid chamber; and communicating channels each of which communicates one of The pressure chambers and the common liquid chamber are formed in a plate which is included in the plates and which is in contact With a surface of the pressure chamber plate on a side opposite to the piezoelectric actuator.

10. The liquid-droplet jetting apparatus according to claim 1, wherein:

the piezoelectric actuator includes a vibration plate which is arranged on the one surface of the channel unit so as to cover the pressure chambers, and is extended from the area facing the pressure chambers up to the another area facing the common liquid chamber;

the piezoelectric layer is arranged on a surface of the vibration plate on a side opposite to the pressure chambers; and the supporting sections are in contact with a surface of the vibration plate on a side of the pressure chambers, and are extended, from an inner surface defining the common liquid chamber, up to positions each facing one of the contact points.

11. The liquid-droplet jetting apparatus according to claim 1, wherein:

the pressure chambers have an elongated shape; and each of the contact points is arranged to be shifted from a center of one of the pressure chambers in a direction of width of one of the pressure chambers.

12. The liquid-droplet jetting apparatus according to claim 1, wherein:

the common liquid chamber includes a plurality of liquid chambers; and a pressure chamber, included in the pressure chambers, is communicated with a liquid chamber which is included in the liquid chambers and which overlaps with a contact point included in the contact points and connected to an individual electrode included in the individual electrodes and corresponding to the pressure chamber.

13. The liquid-droplet jetting apparatus according to claim 1, wherein:

the common liquid chamber includes a plurality of liquid chambers; and a pressure chamber, included in the pressure chambers, is communicated with a liquid chamber included in the liquid chambers and different form another liquid chamber which overlaps with a contact point included in the contact points and connected to an individual electrode included in the individual electrodes and corresponding to the pressure chamber.

14. The liquid-droplet jetting apparatus according to claim 1, wherein each of the contact points, corresponding to one of the pressure chambers, and communicating channels, communicating one of the pressure chambers and the common liquid chamber, are formed on mutually opposite sides, respectively, of one of the pressure chambers, sandwiching one of the pressure chambers therebetween.

15. A liquid transporting apparatus which transports a liquid, comprising:

a channel unit which includes a plurality of pressure chambers arranged along a plane, and a common liquid chamber arranged along the plane and adjacent to the pressure chambers; and a piezoelectric actuator which applies a pressure to a liquid in the pressure chambers by selectively changing volumes of the pressure chambers, and which includes: a vibration plate which is arranged on one surface of the channel unit so as to cover the pressure chambers, and is extended from an area facing the pressure chambers up to another area facing the common liquid chamber; a piezoelectric layer arranged on a surface of the vibration plate, on a side opposite to the pressure chambers, at the area facing the pressure chambers; a plurality of individual electrodes arranged, on a surface of the piezoelectric layer on a side opposite to the pressure chambers, at the area facing the pressure chambers; a plurality of contact points which are connected to the individual electrodes respectively; and a common electrode which is arranged on a surface of the piezoelectric layer on a side of the pressure chambers;

wherein each of the contact points is drawn, on the surface of the vibration plate on the side opposite to the pressure chambers, from one of the individual electrodes up to the another area facing the common liquid chamber; and the channel unit is provided with a plurality of supporting sections which are formed in the channel unit, which are in contact with a surface of the vibration plate on a side of the common liquid chamber, and which are extended from an inner surface of the common liquid chamber up to positions each facing one of the contact points.

* * * * *